US010717180B2

(12) United States Patent
Fan et al.

(10) Patent No.: US 10,717,180 B2
(45) Date of Patent: Jul. 21, 2020

(54) FASTENER TOOL HAVING AUTO IGNITION

(71) Applicant: Illinois Tool Works Inc., Glenview, IL (US)

(72) Inventors: Chinbay Q. Fan, Chicago, IL (US); Patrick Talano, Chicago, IL (US); James Haberstroh, Vernon Hills, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 286 days.

(21) Appl. No.: 15/833,525

(22) Filed: Dec. 6, 2017

(65) Prior Publication Data

US 2018/0169846 A1 Jun. 21, 2018

Related U.S. Application Data

(60) Provisional application No. 62/434,663, filed on Dec. 15, 2016.

(51) Int. Cl.

| | |
|---|---|
| ***B25C 1/18*** | (2006.01) |
| ***B25C 1/08*** | (2006.01) |
| ***B25C 1/16*** | (2006.01) |

(52) U.S. Cl.

CPC ..... *B25C 1/18* (2013.01); *B25C 1/08* (2013.01); *B25C 1/163* (2013.01)

(58) Field of Classification Search

CPC ..... B25C 1/18; B25C 1/08; B25C 1/163
USPC ..... 227/10, 129, 156; 123/3, 306; 173/104, 173/170, 171; 60/275, 286
See application file for complete search history.

(56) References Cited

U.S. PATENT DOCUMENTS 4,653,380 A 3/1987 Griffing et al.
4,739,915 A * 4/1988 Cotta ..... B25C 1/08 123/46 SC (Continued)

FOREIGN PATENT DOCUMENTS

WO WO 2007/048006 4/2007

OTHER PUBLICATIONS

International Search Report and Written Opinion for International Application No. PCT/US2017/065029, dated Mar. 28, 2018 (13 pages).

(Continued)

*Primary Examiner* — Nathaniel C Chukwurah
(74) *Attorney, Agent, or Firm* — Neal, Gerber & Eisenberg LLP

(57) ABSTRACT

Various embodiments of the present disclosure provide a powered fastener driving tool with an auto ignition assembly. In certain embodiments, the tool includes a housing containing a combustion chamber, a removable fuel container configured to communicate fuel into the combustion chamber, a removable oxidizer container configured to communicate an oxidizer into the combustion chamber, a piston and a fastener driving blade connected to the piston and configured to engage and drive fasteners upon the fuel and the oxidizer chemically reacting in the combustion chamber. In certain embodiments, the auto ignition assembly includes a catalyst in the combustion chamber for causing, enhancing, or accelerating the reaction between the fuel and the oxidizer.

18 Claims, 4 Drawing Sheets

(56) References Cited

U.S. PATENT DOCUMENTS

| | | | | |
|---|---|---|---|---|
| 5,749,509 | A * | 5/1998 | Remerowski | B25C 1/082 227/10 |
| 5,842,623 | A * | 12/1998 | Dippold | B25C 1/143 227/10 |
| 5,932,837 | A | 8/1999 | Rusek et al. | |
| 7,168,603 | B1 * | 1/2007 | Lund | A01D 34/00 123/3 |
| 2004/0134961 | A1 | 7/2004 | Wolf et al. | |
| 2005/0044851 | A1 * | 3/2005 | Goldfarb | B25J 9/1095 60/508 |
| 2011/0139849 | A1 * | 6/2011 | Rousson | B25C 1/008 227/10 |
| 2013/0048696 | A1 | 2/2013 | Largo et al. | |
| 2016/0244684 | A1 | 8/2016 | Vanstaan | |

OTHER PUBLICATIONS

Cong et al., Study on Kerosene Based Fuel with Hydrogen Peroxide for Hypergolic Application, European Space Agency, 2004 (6 pages).

Davies, Autoignition Study of Ethanol and Heptane in a Rapid Compression Machine, A Thesis Presented to the Graduate Faculty of the University of Akron, May 2015 (84 pages).

Davis et al., Advances in Hypergolic Propellants: Ignition, Hydrazine, and Hydrogen Peroxide Research, Hindawi Publishing Corporation, Sep. 15, 2014 (10 pages).

Jayakumar, Effect of Intake Temperature and Boost Pressure on the Auto-Ignition of Fuels with Different Cetane Numbers and Volatilities, Wayne State University, 2013 (219 pages).

Jo et al., Autoignition Tests by Injecting Kerosene into Vortex of Decomposed Hydrogen Peroxide, the American Institute of Aeronautics and Astronautics, Inc., Jul. 2010 (9 pages).

Keese et al., Hydrogen Peroxide-Based Propulsion and Power Systems, Sandia National Laboratories, Apr. 2004 (22 pages).

Natan et al., Hypergolic Ignition of Oxidizers and Fuels by Fuel Gelation and Suspension of Reactive or Catalyst Particles article, the American Institute of Aeronautics and Astronautics, Inc., Jul. 2010 (7 pages).

Welz et al., New Insights into Low-Temperature Oxidation of Propane from Synchrotron Photoionization Mass Spectrometry and Multi-Scale Informatics Modeling, Sandia National Laboratories, 2015 (43 pages).

* cited by examiner

FASTENER TOOL HAVING AUTO IGNITION

PRIORITY

This application claims priority to and the benefit of U.S. Provisional Patent Application Ser. No. 62/434,663, filed Dec. 15, 2016, the entire contents of which are incorporated herein by reference.

BACKGROUND

Powered fastener driving tools are well known and commercially widely used throughout the world. Powered fastener driving tools are typically electrically powered, pneumatically powered, combustion-powered, or powder activated. Powered fastener driving tools are typically used to drive fasteners (such as nails, staples, and the like) to connect a first material, item, or workpiece to a second material, item, workpiece, or substrate.

Various known powered fastener driving tools typically include: (a) a housing; (b) a power source or supply assembly in, connected to, or supported by the housing; (c) a fastener supply assembly in, connected to, or supported by the housing; (d) a fastener driving assembly in, connected to, or supported by the housing; (e) a trigger mechanism partially in, connected to, or supported by the housing; and (f) a workpiece contactor or contacting element (sometimes referred to herein as a "WCE") connected to or supported by the housing. The WCE is configured to engage or contact a workpiece and to operatively work with the trigger mechanism such that the WCE needs to be depressed or moved inwardly a predetermined distance with respect to the housing before activation of the trigger mechanism causes actuation of the power fastener driving tool.

Powered fastener driving tools typically have two different types of operational modes and one or more mechanisms that enable the operator to optionally select one of the two different types of operational modes that the operator desires to use for driving the fasteners. One operational mode is known in the industry as the sequential or single actuation operational mode. In this operational mode, the depression or actuation of the trigger mechanism will not (by itself) initiate the actuation of the powered fastener driving tool and the driving of a fastener into the workpiece unless the WCE is sufficiently depressed against the workpiece. In other words, to operate the powered fastener driving tool in accordance with the sequential or single actuation operational mode, the WCE must first be depressed against the workpiece followed by the depression or actuation of the trigger mechanism. Another operational mode is known in the industry as the contact actuation operational mode. In this operational mode, the operator can maintain the trigger mechanism at or in its depressed position, and subsequently, each time the WCE is in contact with, and sufficiently pressed against the workpiece, the power fastener driving tool will actuate, thereby driving a fastener into the workpiece.

As mentioned above, various known powered fastener driving tools are combustion-powered. Many combustion-powered fastener driving tools are powered by a rechargeable battery (or battery pack) and a replaceable fuel cell or cartridge. Various combustion-power fastener driving tools, battery packs, and fuel cells have been available commercially from ITW-Paslode of Vernon Hills, Ill. (a division of Illinois Tool Works, Inc., the assignee of this application).

In these combustion-powered fastener driving tools, the fuel cell or cartridge supplies fuel, and the battery provides a spark or energy to ignite the fuel. The battery powered sparks ignite the fuel to generate high pressure gas that moves the piston and attached driving blade to strike a fastener such as a nail from the nail magazine.

These combustion-powered fastener driving tools typically include a control system with a fan for supplying air and purging exhaust. Certain of these known fuel cells contain a valve that meters out the same amount of fuel each time its valve stem is depressed. Certain of these known fuel cells enable fuel dispensing when the tool is in any orientation.

Such known combustion-powered fastener driving tools are often more powerful than electrically powered, pneumatically powered, or powder activated fastener driving tools. Combustion-powered fastener driving tools are typically thus used for higher power required applications such as attaching a metal object to a concrete wall wherein the fastener has to be driven through the metal object and into the concrete wall. This is opposed to a lower powered fastener driving tool such as certain pneumatically powered tools that are used to attach one wooden member or object to another wooden member or object.

There are certain disadvantages with such known combustion powered fastener driving tools, and the fuel cells and batteries therefore. Certain known fuel cells for these tools contain a high pressure propellant gas that has a limited shelf life. Certain known batteries in these tools need to be charged relatively frequently. Certain known batteries for these tools also have reduced lifetimes due to sudden discharges.

Since such known combustion-powered fastener driving tools use such rechargeable batteries (or battery packs) and consumable fuel cells, there is a continuing need to make combustion-powered fastener driving tools more efficient.

There is also a need to provide high powered fastener driving tools that provide the same or greater power levels as combustion-powered fastener driving tools without the need for such batteries and/or fuel cells, or other known batteries and/or known fuel cells.

SUMMARY

Various embodiments of the present disclosure provide a powered fastener driving tool having an auto ignition assembly that provides necessary power levels for driving fasteners such as nails. In various embodiments of the present disclosure, the powered fastener driving tool includes a housing that supports a piston connected to a driving blade, wherein the auto ignition assembly produces a high pressure gas to activate the piston.

In various embodiments of the present disclosure, the powered fastener driving tool includes an auto ignition assembly that: (a) uses a flexible fuel that is activated by an oxidizer to drive the piston; (b) uses an oxidizer that includes a stabilizer for safety purposes; (c) uses a catalyst to cause, enhance or accelerate the chemical reaction between the fuel and the oxidizer; (d) is configured to receive two or more replaceable fuel and oxidizer cartridges or a replaceable dual cartridge system that contains both the flexible fuel and the oxidizer; (d) provides relatively high adjustable power levels; (e) provides a fuel and an oxidizer that each have an increased shelf life; and (f) eliminates the need for certain batteries (or battery packs) in such tools.

In various embodiments of the present disclosure, the powered fastener driving tool includes a housing configured to support a removable fuel container and a removable oxidizer container, a piston chamber in the housing, a combustion chamber in the housing, a piston disposed in the piston chamber, and a fastener driving blade connected to the piston and configured to engage and drive a fastener when fuel from the fuel container reacts with an oxidizer from the oxidizer container in the combustion chamber. In various embodiments, the powered fastener driving tool includes a catalyst in the combustion chamber for causing, enhancing, or accelerating the reaction between the fuel and the oxidizer in the combustion chamber.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
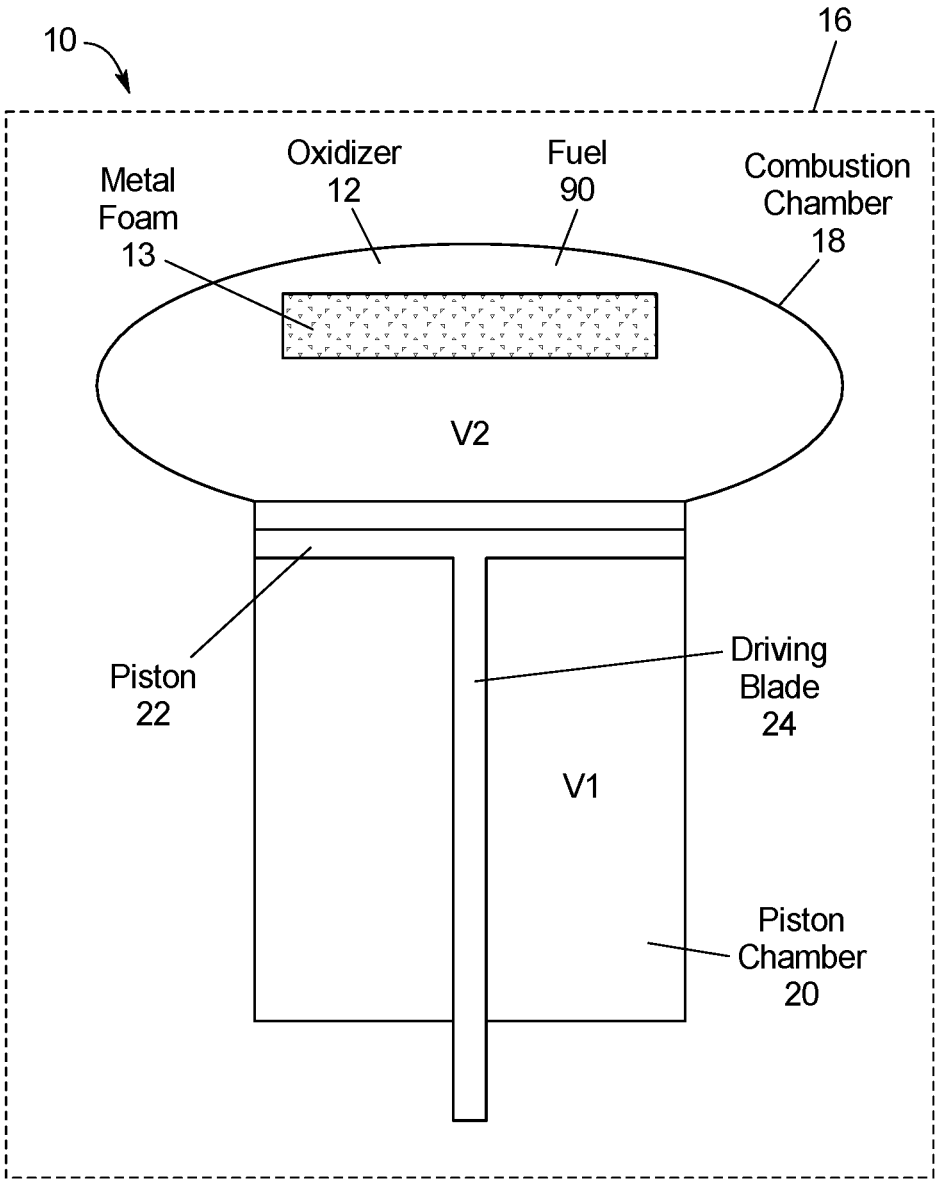
FIG. 1 is a diagrammatic view of part of a fastener driving tool including an auto ignition assembly of one example embodiment of the present disclosure.

Various embodiments of the present disclosure provide a powered fastener driving tool having an auto ignition assembly that produces a high pressure gas to activate the piston and thus provides necessary power levels for driving fasteners such as nails. In various embodiments of the present disclosure, the powered fastener driving tool includes a housing that supports a piston connected to a driving blade.

In various embodiments, the auto-ignition assembly provides a spontaneous combustion to produce high-pressure gas to actuate the piston of the powered fastener driving tool. The high pressure gas is caused by a fuel bursting into a flame as a result of a chemical reaction with an oxidizer, without the addition of heat or a spark from an external source.

In various embodiments, the auto ignition assembly causes the fuel and oxidizer to be mixed together in a combustion chamber to generate the high pressure gas.

In various embodiments, the auto ignition assembly produces a high pressure gas without any spark needed to ignite the fuel.

In various embodiments, the auto ignition assembly employs controlled energetic materials or explosive materials.

In various embodiments, the auto ignition assembly provides a controlled explosion in the form of a rapid expansion of matter into a much greater volume.

In various embodiments, the auto ignition assembly controls the expansion such that the energy is transferred substantially or almost completely into mass motion of the piston.

In various embodiments, the auto ignition assembly is different from homogeneous charge compression ignition (HCCI), in which well-mixed fuel and oxidizer (such as air) are compressed to the point of automatic ignition. Rather, in various embodiments, the disclosed auto-ignition is based on the fuel and oxidizer meeting on or at a catalyst for ignition.

In various embodiments, the auto ignition assembly includes an energetic oxidizer that interfaces with a fuel. When the high pressure gas is needed, the auto ignition assembly causes the energetic oxidizer to react with the fuel to generate sudden pressure against the piston.

In various embodiments, the auto ignition assembly provides sudden pressure as high as 10 bars (150 psig) or even higher (110 bars or 11 MPa or 1,595 psig).

In various embodiments, the auto ignition assembly generates high pressure gas in situ and simultaneously at a millisecond level.

Example Fuels for the Auto Ignition Assembly

In various embodiments, the auto ignition assembly employs a fuel that is in a liquid form. In various embodiments, the liquid fuel includes a petroleum fuel such as kerosene or gasoline. In various embodiments, the liquid fuel includes a butene. In various embodiments, the liquid fuel includes an alcohol, such as methanol, ethanol, propanol, or combinations thereof.

In other embodiments, the auto ignition assembly employs a fuel that is in a solid form. In various embodiments, the solid fuel includes a metal powder, a sawdust, or a plastic. In various embodiments, the liquid fuel includes aluminum powder or iron powder or combinations thereof.

In other embodiments, the auto ignition assembly employs a fuel that is in a gaseous form. In various embodiments, the gaseous fuel includes a hydrocarbon gas such as propane, butane, propylene, butylene, or combinations thereof. In various embodiments, the gaseous fuel includes an alkane, such as methane, ethane, propane, or butane, or an alkene, such as ethylene, propylene, butylene, butadiene, kerosene, naphtha, liquefied petroleum gas (LPG), and any other saturated as well as unsaturated hydrocarbons, or combinations thereof; alcohols such as propanol, butanol; ketones such as acetone, and other possible combustible gas or liquid fuels. It should also be appreciated that in various embodiments, certain solid fuels such as cellulose, sugar, active carbon, could be used for this application. However, certain solid fuels may need special delivery methods and may not be optimal for this power tool use.

In various different embodiments, example fuels include: (1) nitrobenzene; (2) nitronaphthalene; (3) nitrotoluenes; (4) nitrocellulose; (5) picric acid; (6) petroleum; (7) turpentine; (8) naphtha; (9) castor oil, sugar, glycerin; (10) acetylene wax, paraffin, sawdust; (11) halogenated hydrocarbons; (12) halogens; (13) powdered metals; (14) carbon disulfide ($CS_2$); (15) phosphorus ($P_4$); and (16) octasulfur ($S_8$).

Example Oxidizers of the Auto Ignition Assembly

In various embodiments, the auto ignition assembly employs an oxidizer in a solid form.

In other embodiments, the auto ignition assembly employs an oxidizer in a liquid form.

In other embodiments, the auto ignition assembly employs an oxidizer in a gaseous form.

In various different embodiments, example oxidizers include: (1) oxygen and halogens; (2) perchlorates such as: $KClO_4$, $NH_4ClO_4$, $NaClO_4$, $HClO_4$, $Ba(ClO_4)_2$, & $Ca(ClO_4)_2$; (3) chlorates such as: $KClO_3$, $LiClO_3$, $NaClO_3$, $Mg(ClO_3)_2$, & $Ba(ClO_3)_2$; (4) hypochlorites such as: $Ca(ClO)_2$, NaClO, & HClO; (5) nitrates such as: $KNO_3$, $NH_4NO_3$, $NaNO_3$, $HNO_3$, $Ba(NO_3)_2$, $AgNO_3$, & $Sr(NO_3)_2$; (6) chromates such as: $PbCrO_4$, $BaCrO_4$, $CaCrO_4$, & $K_2CrO_4$; (7) dichromates such as: $K_2Cr_2O_7$ & $NH_4Cr_2O_7$; (8) iodates such as $KIO_3$, $Pb(IO_3)_2$, & $AgIO_3$; (9) permanganates such as: $KMnO_4$; (10) metal oxides such as: $BaO_2$, $Cu_2O$, CuO, $Fe_2O_3$, $Fe_3O_4$, $PbO_2$, $Pb_3O_4$, PbO, $MnO_2$, & ZnO; (11) nitrogen oxides such as: $NO_2$ & $N_2O_4$; (12) peroxides such as: $Na_2O_2$, $H_2O_2$, & dibenzoyl peroxide (DBPO), and combinations thereof.

In various different embodiments, the oxidizer is hydrogen peroxide ($H_2O_2$), such as a high purity hydrogen peroxide with an optional stabilizer, nitric acid ($HNO_3$), dinitrogen tetraoxide ($N_2O_4$), a fluorine based oxidizer (e.g., fluorine, $ClF_3$, and $FClO_3$), $Fe_2O_3$, and other possible energetic oxidizers. In some such embodiments, the oxidizer is hydrogen peroxide ($H_2O_2$) or nitric acid ($HNO_3$), preferably hydrogen peroxide.

Example Stabilizers of the Auto Ignition Assembly

In various embodiments, the auto ignition assembly includes one or more stabilizers that stabilize the oxidizer. In various embodiments, example stabilizers include: metal chelating agents and colloids including stannates, pyrophosphates and organophosphonates. In various embodiments, the stabilizer is: colloidal stannate; sodium pyrophosphate; an organophosphonate (e.g., Monsanto's Dequest products); nitrate; phosphoric acid; colloidal silicate; or combinations thereof.

In various embodiments, the stabilizer is a hydrogen peroxide stabilizer.

Example Catalysts of the Auto Ignition Assembly

In various embodiments, the catalyst includes a liquid or gaseous catalyst solution for causing, enhancing, or accelerating the reaction of the oxidizer and the fuel in the combustion chamber in the housing of the tool.

In various embodiments, the catalyst includes a solid material positioned in the combustion chamber in the housing of the tool for causing, enhancing, or accelerating the reaction of the oxidizer and the fuel in the combustion chamber.

In various embodiments, the auto ignition assembly employs a catalyst in the form of a metal foam in the combustion chamber in the housing of the tool for causing, enhancing, or accelerating the reaction or fuel ignition in the combustion chamber. In various embodiments, the metal foam includes a metal or metal alloy such as iron, iron alloy, steel, aluminum, aluminum alloy, chromium, titanium, cobalt lead, nickel, manganese, molybdenum, copper, and combinations thereof. In various embodiments, the auto ignition assembly includes a metal foam catalyst including a noble metal such as ruthenium, rhodium, palladium, platinum, silver, osmium, and/or gold to increase the combustion efficiency.

In various embodiments, the auto ignition assembly employs a catalyst in the form of a stainless steel foam in the combustion chamber in the housing of the tool for causing, enhancing, or accelerating the reaction or fuel ignition in the combustion chamber. In certain such embodiments, the iron in the stainless steel is a good catalyst for hydrogen peroxide decomposition and fuel oxidation.

In various embodiments, the auto ignition assembly includes a metal foam catalyst in the combustion chamber that also functions as a filter and/or collector to remove deposited stabilizers from the oxidizer.

In various embodiments, the auto ignition assembly includes a metal foam catalyst in the combustion chamber that also functions as a filter and/or collector to soot.

In various embodiments, the auto ignition assembly includes a metal foam catalyst in the combustion chamber that also functions as a filter and/or collector to remove carbon particles.

In various embodiments, the auto ignition assembly includes a metal foam catalyst in the combustion chamber that also functions as a filter and/or collector to remove un-reacted fuels.

In various embodiments, the auto ignition assembly includes a catalyst in the form of a metal foam positioned in the combustion chamber that additionally functions as a filter and also a heat distributor without hotspots.

Example Combinations of Fuels and Oxidizers for the Auto Ignition

In various embodiments, the auto ignition assembly includes a hypergolic combination of an oxidizer and a fuel. One example of a hypergolic combination is a hydrazine based fuel combined with a nitrogen oxide such as dinitrogen tetraoxide. Another example of a hypergolic combination is a hydrocarbon fuel, such as propane, butene, or combinations thereof, and a peroxide, such as hydrogen peroxide. Another example of a hypergolic combination is an alcohol fuel, such as propanol, and a permanganate, such as sodium permanganate.

In various embodiments, the auto ignition assembly includes a metallic fuel, such as aluminum, and an oxidizer. The oxidizer may be, for example, iron oxide, molybdenum oxide, tungsten trioxide, manganese dioxide, copper oxide, bismuth oxide, or a fluoropolymer, or combinations thereof.

The list below provides example fuel and oxidizer combinations that can be used to form controlled composite explosions for the auto ignition assembly of various example embodiments of the present disclosure. Most of these example embodiments contain no nitrogen. Most of these example embodiments are either commercially available or easily prepared.

Ten highly energetic reactant mixtures that can be used as example fuel and oxidizer combinations that for the auto ignition assembly of various embodiments of the present disclosure are:

$$Fe_2O_3+2Al \rightarrow Al_2O_3+2Fe+\Delta H\ (-16.4\ kJ\ cm^{-3})$$

$$3Fe_3O_4+8Al \rightarrow 4Al_2O_3+9Fe+\Delta H\ (-15.6\ kJ\ cm^{-3})$$

$$3MoO_2+4Al \rightarrow 2Al_2O_3+3Mo+\Delta H\ (-16.1\ kJ\ cm^{-3})$$

$$WO_3+2Al \rightarrow Al_2O_3+W+\Delta H\ (-15.9\ kJ\ cm^{-3})$$

$$3MnO_2+4Al \rightarrow 2Al_2O_3+3Mn+\Delta H\ (-19.4\ kJ\ cm^{-3})$$

$$MoO_3+2Al \rightarrow Al_2O_3+Mo+\Delta H\ (-17.8\ kJ\ cm^{-3})$$

$$3CuO+2Al \rightarrow Al_2O_3+3Cu+\Delta H\ (-20.8\ kJ\ cm^{-3})$$

$$3(\text{—}C_2F_4\text{—})+4Al \rightarrow 4AlF_3+6C+\Delta H\ (-21\ kJ\ cm^{-3})$$

$$Bi_2O_3+2Al \rightarrow Al_2O_3+2Bi+\Delta H\ (-15.2\ kJ\ cm^{-3})$$

$$3I_2O_5+10Al \rightarrow 5Al_2O_3+61+\Delta H\ (-25.7\ kJ\ cm^{-3})$$

In various embodiments, the auto ignition assembly uses fuels that are propane or butene or combinations thereof, an oxidizer that is 80% hydrogen peroxide, and a catalyst that is a sodium permanganate monohydrate solution. In various such embodiments, the catalyst can stand alone or be mixed with oxidizer or fuels upon the solubility. In various embodiments, the fuel can also be an alcohol, such as propanol, which can mix with an oxidizer, such as sodium permanganate monohydrate solution.

In various embodiments, the auto ignition assembly includes one or more stabilizers that stabilize the oxidizer. In one example, the oxidizer is a high concentration hydrogen peroxide oxidizer and the stabilizer is: (a) a colloidal stannate; (b) sodium pyrophosphate (such as present at 25-250 mg/L); (c) an organophosphonate (e.g., Monsanto's Dequest products); (d) Nitrate (for pH adjustment and corrosion inhibition), or (e) phosphoric acid (for pH adjustment <4).

Fuel and Oxidizer Containers or Cartridges

In various embodiments, the auto ignition assembly (or the housing of the tool) is configured to receive a plurality of individual containers or cartridges including one or more containers or cartridges holding the fuel and one or more containers or cartridges holding the oxidizer. In such embodiments, the auto ignition assembly and the containers or cartridges are configured to prevent any cross-contamination and/or self-discharge.

In various embodiments, the auto ignition assembly (or the housing of the tool) is configured to receive one or more dual containers or cartridges, wherein each container or cartridge has a fuel holding chamber and an oxidizer holding chamber. In such embodiments, the auto ignition assembly and the containers or cartridges are configured to prevent any cross-contamination and/or self-discharge.

In various embodiments, the containers or cartridges for the auto ignition assembly facilitate increased shelf life for the fuel and the oxidizer.

1$^{st}$ Example Tool Configuration

Referring now to FIG. 1, a diagrammatic configuration for part of a fastener driving tool with the auto ignition assembly of one example embodiment of the present disclosure is generally shown. In this example embodiment, the fastener driving tool is generally indicated by numeral 10 and includes a housing (not shown in detail but generally indicated by the phantom line labeled 16). The housing 16 includes or contains: (a) piston chamber 20 in the housing 16; (b) a combustion chamber 18 in the housing 16; (c) a removable fuel container (not shown) configured to communicate fuel 90 into the combustion chamber 18; (d) a removable oxidizer container (not shown) configured to communicate the oxidizer 12 into the combustion chamber 18; (e) a catalyst 13 in the combustion chamber 18 which in this illustrated example embodiment is in the form of a metal foam; (f) a piston 22 disposed in the piston chamber 20; and (g) and a fastener driving blade 24 connected to the piston 22, partly disposed in the piston chamber 20, and configured to engage and drive fasteners (not shown).

2$^{nd}$ Example Tool Configuration

Figure 2:
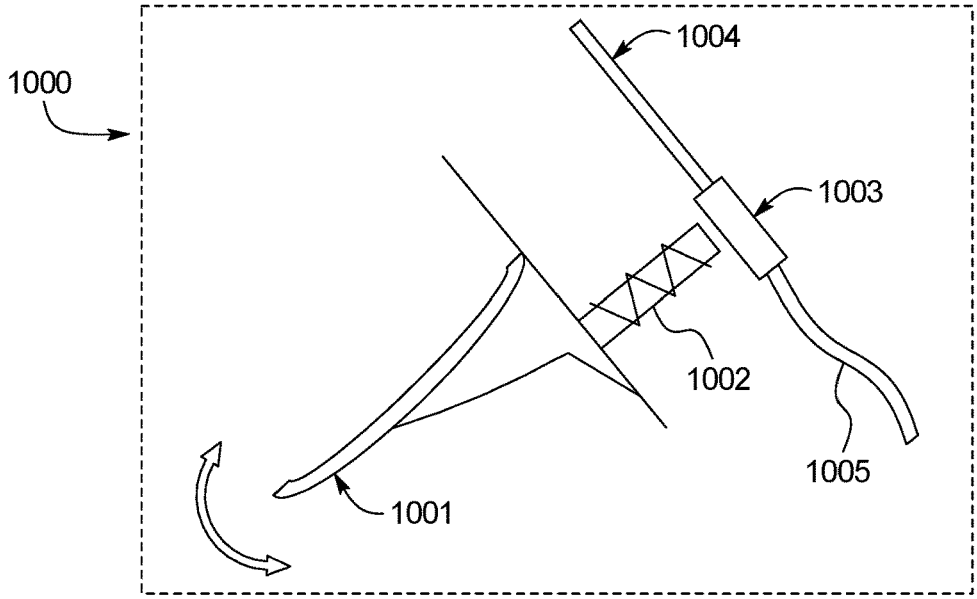
FIGS. 2 and 3 are diagrammatic views of part of a fastener driving tool including an auto ignition assembly of another example embodiment of the present disclosure.
Figure 3:
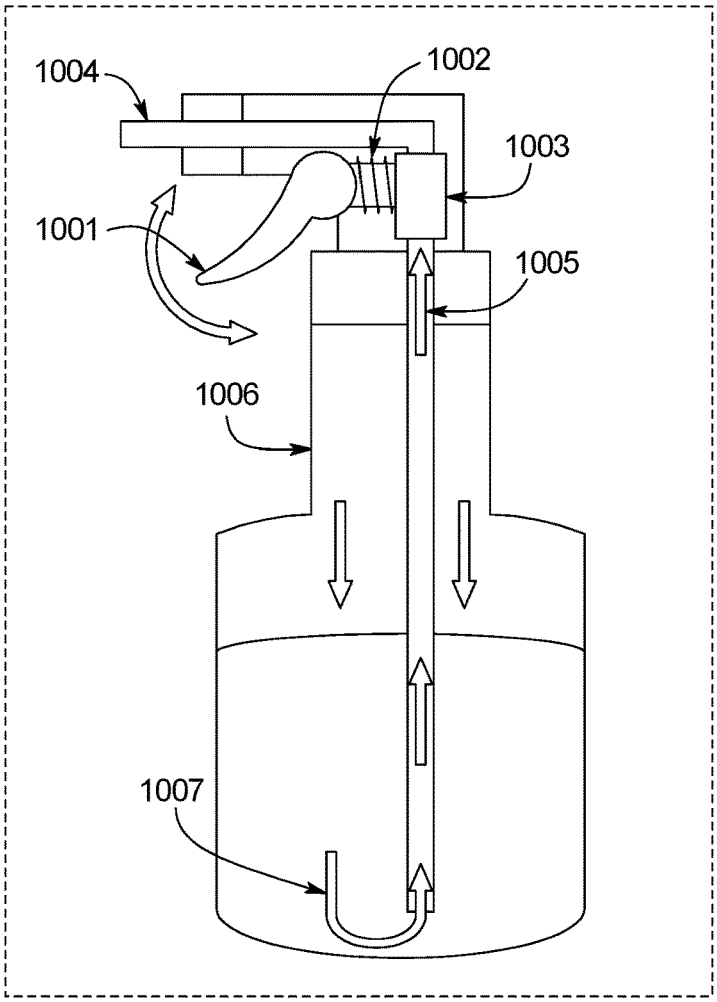

Referring now to FIGS. 2 and 3, a diagrammatic configuration for a fastener driving tool generally indicated by numeral 1000 and having an auto ignition assembly of another example embodiment of the present disclosure is generally shown. In particular, FIGS. 2 and 3 illustrate one way to dispense fuel into the combustion chamber of the auto ignite assembly of the fastener driving tool. In this example embodiment, the fastener driving tool 1000 includes a housing (not shown) containing: (a) piston chamber (not shown) in the housing; (b) a combustion chamber (not shown) in the housing; (c) a removable fuel container or bottle 1006 configured to communicate fuel 1007 into the combustion chamber; (d) a removable oxidizer container (not shown) configured to communicate a oxidizer into the combustion chamber; (e) a piston (not shown) disposed in the piston chamber; and (f) and a fastener driving blade (not shown) connected to the piston, partly disposed in the piston chamber, and configured to engage and drive fasteners (not shown).

In this illustrated embodiment, an activation or pump of the trigger 1001 pushes against a spring loaded bar 1002 forcing air initially from a nozzle 1003. The escape of air causes a sudden drop in air pressure at the top of the tube 1005 in the bottle 1006. The air inside the top of the bottle 1006 is at higher pressure than the air in the tube 1005, so it pushes down on the liquid fuel 1007. The liquid fuel 1007 is forced up the tube toward the pump mechanism. The liquid fuel 1007 leaves the pump mechanism as a fine mist 1004 which enters the combustion chamber. The respective inner diameters (IDs) of the tube and nozzle can be varied for these embodiments to control the ratio for the amount of liquid fuel dispensed.

In certain embodiments, the liquid injection system of this type of tool is a liquid injection system that is identical or similar to a known conventional battery operated liquid injection systems that have been used in known battery powered tooth brushes and other devices.

In certain embodiments, this pump system can be used for bump fire of fasteners in case the bottle spray does not spray fast enough.

In certain embodiments, when the tool starts to work, the tool initially uses the bottle spray function to fire fasteners. As the tool warms up quickly, the tool can be operated either in the bottle spray mode or in a thermal electric generator (TEG) operated mode.

In certain embodiments, the bottle contains only the liquid ingredient (i.e., there's no propellant at all). When the trigger mechanism is pumped or activated, the lower air pressure in the tube runs down into the bottle. Because there's air inside the bottle, at the top, the liquid is forced up the tube. The pump mechanism forces some of this liquid out through the tube into a much smaller nozzle, so it turns into a relatively high-speed aerosol of tiny droplets.

3$^{rd}$ Example Tool Configuration

Figure 4:
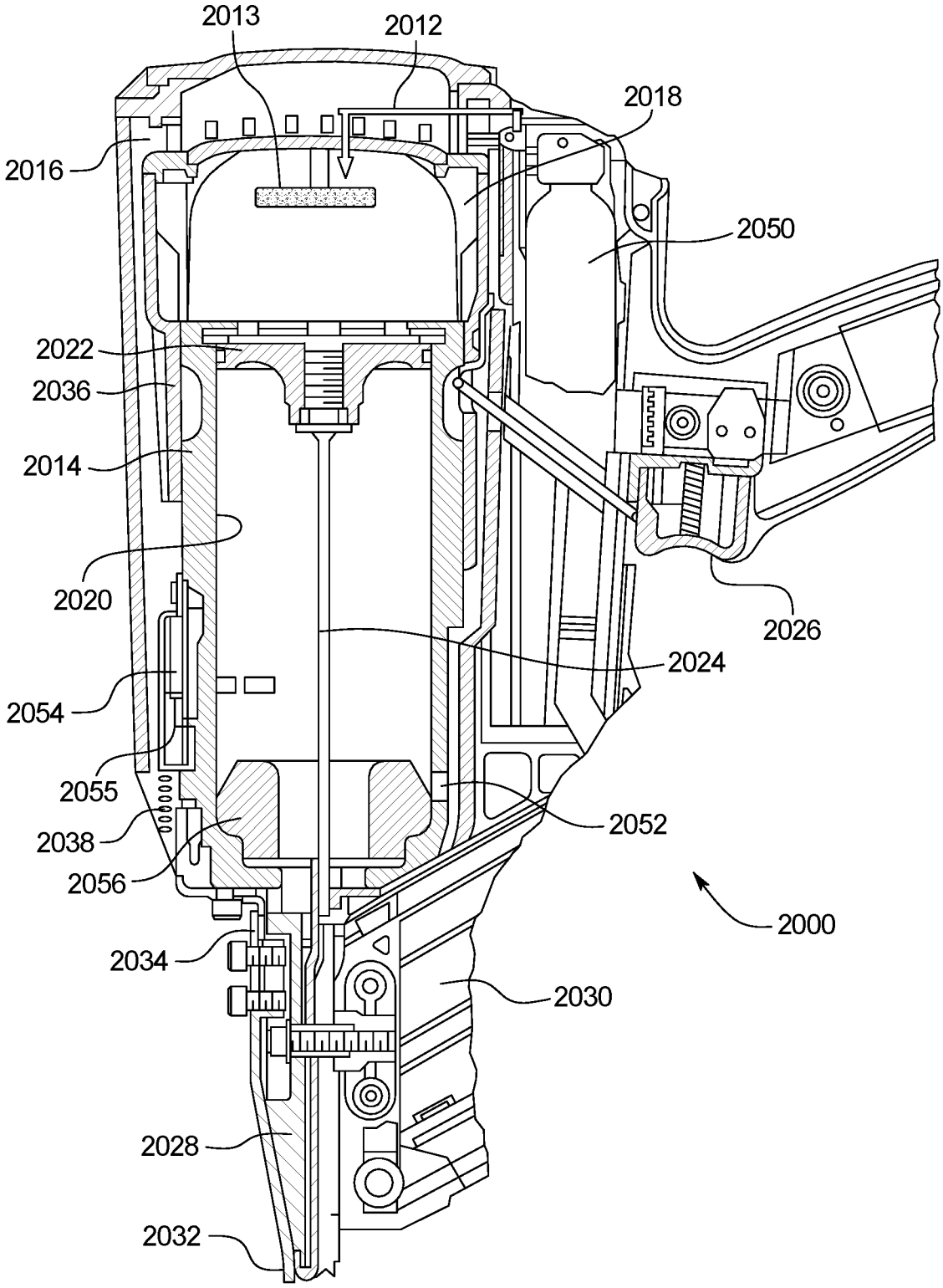
FIG. 4 is a cross sectional view of a fastener driving tool including an auto ignition assembly of another example embodiment of the present disclosure.

Referring now to FIG. 4, another example embodiment for a fastener driving tool with the auto ignition assembly of the present disclosure is generally shown. This fastener driving tool generally is indicated by numeral 2000 and is somewhat similar to the fastener driving tool disclosed in U.S. Patent Publication 2013/0048696 with the exception of the auto ignition assembly. In this illustrated example embodiment, the fastener driving tool 2000 includes: (a) a housing 2016; (b) a combustion chamber 2018 in the housing 2016; (c) a fuel and oxidizer injection nozzle 2012 supported by the housing 2016; (d) a catalyst 2013 for the auto ignition supported by the housing 2016 and positioned in the combustion chamber 2018; (f) a structure 2014 of the combustion chamber 2018 supported by the housing 2016; (g) a cylinder 2020 supported by the housing 2016; (h) a piston 2022 supported by the housing 2016; (i) a driving blade 2024 supported by the housing 2016; (j) a trigger switch 2026 supported by the housing 2016; (k) a fastener magazine 2030 connected to the housing 2016; (l) a work piece contact element or nose 2032 supported by the housing 2016; (m) a linkage 2034 supported by the housing 2016; (n) a valve sleeve 2036 supported by the housing 2016; (o) a spring for bounce back 2038 supported by the housing 2016; (p) suitable liquid fuel and liquid oxidizer containers 2050 configured to be removably supported by the housing 2016; (q) a vent hole 2052; (r) a thermal electric generator (TEG) 2054 supported by the housing 2016; (s) an exhaust valve 2055 in the housing 2016; and (t) a resilient bumper 2056 supported by the housing 2016.

In this example embodiment, the auto ignition assembly is configured to receive two removable containers holding liquids, and specifically including a fuel container and an oxidizer container.

In this example embodiment, the auto ignition assembly includes a foam catalyst 2013 that causes, enhances, or accelerates the interaction of the fuel and oxidizer.

In certain embodiments, the foam catalyst 2013 includes a stainless steel foam, a nickel foam, or any other metal foam. In certain embodiments, the foam catalyst 2013 is at least partially coated with a silver catalyst, a MnO2 catalyst, or any other suitable catalyst.

In this example embodiment, the tool 2000 includes a thermo-electric generator (TEG) 2054. In certain embodiments, the TEG 2054 is a Peltier device that converts heat to electricity. For example, the TEG 2054 can be product CP85138 from CUI Inc. In certain embodiments, the TEG 2054 operates at the temperature difference >60 C. In certain embodiments, the TEG 2054 can produce power 16W at 2 volts and 8 amps. In certain embodiments, the TEG 2054 provides the power for: (1) a liquid injection system when bump firing (continuous high frequency firing) is needed; and (2) light emitting diodes (LED) display for fuel/oxidizer usage.

It should be appreciated that the auto ignition assembly of the present disclosure can be employed in or with stand-alone power tool or a hybrid pneumatic power tool. In other words, it should be appreciated that the disclosed auto ignition assembly can be used in pneumatic tools as well as cordless tools. It should be appreciated that the auto ignition assembly can thus be employed in pneumatic powered fastener driving tools. In certain such pneumatic tool embodiments, the auto ignition assembly is employed or starts to work when the air hose that supplies pressurized air to the pneumatic tool is disconnected. Thus, for these pneumatic tools, the hose can be disconnected anytime if needed. Once the hose is disconnected, the auto ignition assembly gas generation is in the active mode and the tool can be used with the fuel and oxidizer.

It should be appreciated that the auto ignition assembly of the present disclosure including the oxidizer and the fuel can be used once they are mixed with certain doses after activation of a trigger. Without mixing, the fuel and oxidizer stay in each respective container. This reduce self-discharges and increases shelf lifetime.

It should be appreciated that the auto ignition assembly of the present disclosure can eliminate the need for batteries for ignition of the fuels (which typically consumes relatively large amounts of energy from the battery or batteries).

It should be appreciated that the tools including the auto ignition assembly of the present disclosure can include one or more batteries for screens or sensors and that typically such screens or sensors consume relatively low amounts of energy.

It should be appreciated that the auto ignition assembly of the present disclosure can eliminate the need for a motor and fan for air inlet and purge or exhaust in such tools.

It should be appreciated that the auto ignition assembly of the present disclosure can reduce the weight of the power tools in part by reducing the combustion chamber size. Certain known powered fastener driving tools have a 1 to 1 ratio of the piston chamber size versus the combustion chamber size. The reason for the large combustion chamber is due to the pressure produced from the fuel spark ignition. The pressure from the spark ignition is often around 100 psi. From this ratio, various embodiments of the present disclosure can produce pressure at 300 psi or even higher, and thus the combustion chamber size can be reduced accordingly if less pressure is required. The auto ignition and piston striking in the present disclosure are at the same time. Thus, the combustion chamber pressure can be maintained at certain pressure as needed. For example, if the fasteners need to be driven into a concrete substrate, the striking pressure could be adjusted to high by adjusting the fuel and oxidizer doses.

$4^{th}$ Example Tool Configuration

Figure 5:
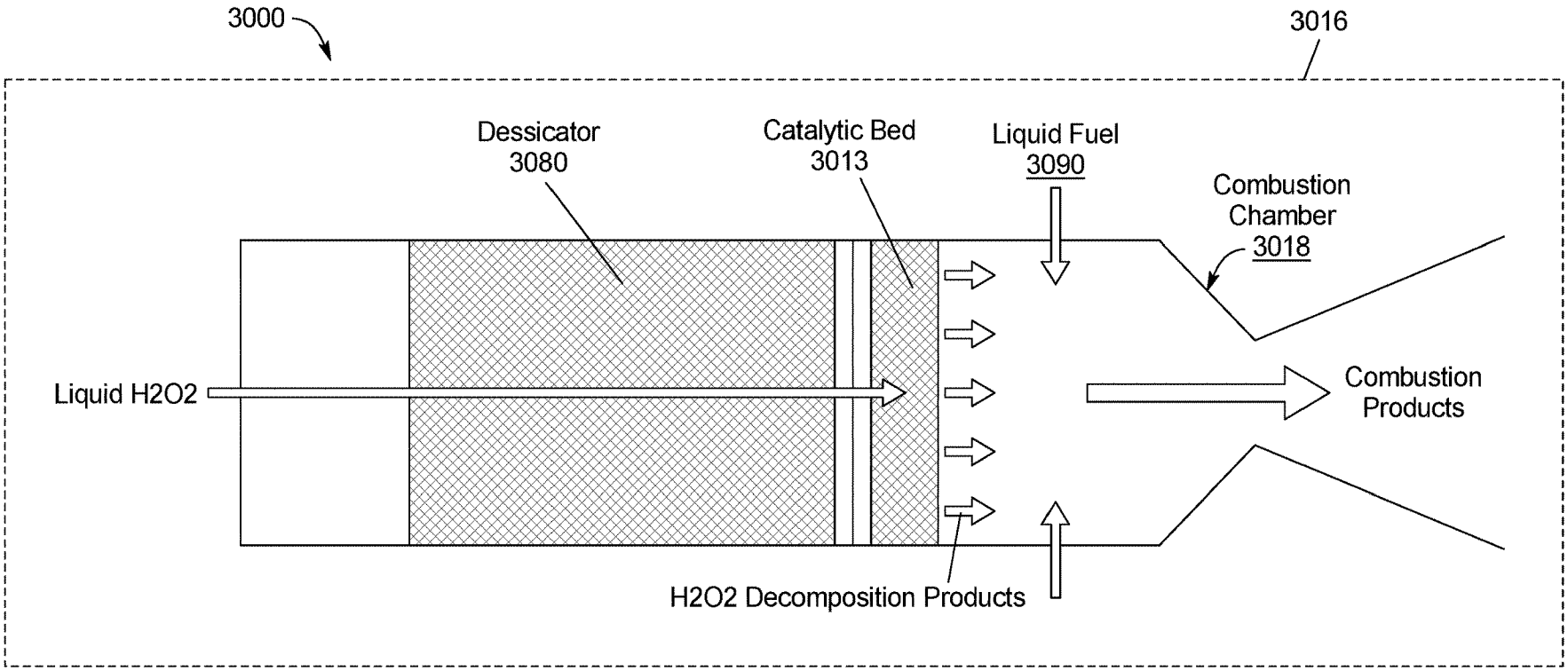
FIG. 5 is a diagrammatic view of part of a fastener driving tool including an auto ignition assembly of another example embodiment of the present disclosure.

Referring now to FIG. 5, a diagrammatic configuration of part of a fastener driving tool auto ignition assembly of a fastener driving tool 3000 of another example embodiment of the present disclosure is generally shown. In this example embodiment, the fastener driving tool 3000 includes a housing (not shown in detail but generally indicated by the phantom line labeled 3016) containing: (a) a piston chamber (not shown) in the housing 3016; (b) a combustion chamber 3018 in the housing 3016; (c) a removable fuel container (not shown) configured to communicate liquid fuel 3090 into the combustion chamber 3018; (d) a removable oxidizer container (not shown) configured to communicate an oxidizer into the combustion chamber 3018; (e) a catalyst bed 3013 that is in communication with, adjacent to, or in the combustion chamber 3018; (f) a piston (not shown) disposed in the piston chamber (not shown); and (g) and a fastener driving blade (not shown) connected to the piston, partly disposed in the piston chamber, and configured to engage and drive fasteners (not shown). In certain such embodiments, the catalytic bed(s) 3013 include a metal foam.

In this illustrated example embodiment of the auto ignition assembly: (a) the liquid fuel 3090 can be an 87 octane gasoline (which includes an 87 percent blend of isooctane and 13 percent n-heptane, or a blend that's equivalent thereto); (b) the oxidizer can be a 70% $H_2O_2$; and (c) the catalyst can be $MnO_2$, Ag mesh, or other suitable catalysts. This illustrated example embodiment of the auto ignition assembly further includes a dessicator 3080 configured to remove water from the $H_2O_2$ oxidizer (i.e., to raise the concentration of the $H_2O_2$ oxidizer in situ). The dessicator 3080 is in communication with or adjacent to the combustion chamber 3018.

More specifically, since 87 octane gasoline will generally not be ignited by 70% $H_2O_2$, the dessicator 3080 is provided to remove (adsorb) water ($H_2O$) from the 70% $H_2O_2$ to create a high concentration $H_2O_2$ (>87%) to cause the interaction of this fuel and oxidizer. In other words, this example embodiment causes the concentration of the $H_2O_2$ oxidizer to increase in situ to ignite the 87 octane gasoline fuel. The adsorbed water evaporates once the fuel combusted to heat up the desiccator.

Alternatively, in this illustrated example embodiment of the auto ignition assembly: (a) the fuel can be a Kerosene ($C_nH_{2n+1}$(n=12-16)) or Naphtha (C7H18) that is a hydrocarbon mixture; (b) the oxidizer can be a 50% and 70% $H_2O_2$; (c) the catalyst can be $MnO_2$, Ag mesh, any Mn oxides, or Ag compounds; and (d) the desiccator can be calcium sulfate (Drierite), calcium chloride, calcium oxide, silica gel.

It will be understood that modifications and variations may be effected without departing from the scope of the novel concepts of the present invention, and it is understood that this application is to be limited only by the scope of the claims.

The invention is claimed as follows:

1. A powered fastener driving tool comprising:

a housing configured to support a removable fuel container and a removable oxidizer container;

a piston chamber in the housing;

a combustion chamber in the housing;

a piston disposed in the piston chamber; and a fastener driving blade connected to the piston and configured to engage and drive a fastener upon a fuel from the fuel container reacting with an oxidizer from the oxidizer container in the combustion chamber, wherein the reaction between the fuel and the oxidizer is a hypergolic reaction.

2. The powered fastener driving tool of claim 1, which includes a catalyst in the combustion chamber.

3. The powered fastener driving tool of claim 2, wherein the catalyst is a solid material.

4. The powered fastener driving tool of claim 2, wherein the catalyst comprises iron.

5. The powered fastener driving tool of claim 2, wherein the catalyst is a foam comprising a metal or a metal alloy.

6. The powered fastener driving tool of claim 2, wherein the catalyst includes a stainless steel foam.

7. The powered fastener driving tool of claim 2, wherein the catalyst is a liquid.

8. The powered fastener driving tool of claim 2, wherein the catalyst includes a sodium permanganate monohydrate solution.

9. The powered fastener driving tool of claim 1, wherein the oxidizer is selected from the group consisting of oxygen, halogen, perchlorate, chlorate, hypochlorite, nitrate, chromate, dichromate, permanganate, metal oxide, nitrogen oxide, peroxide, and combinations thereof.

10. The powered fastener driving tool of claim 1, wherein the oxidizer is a peroxide.

11. The powered fastener driving tool of claim 1, wherein the oxidizer is a hydrogen peroxide.

12. The powered fastener driving tool of claim 1, wherein the fuel is selected from the group consisting of a metallic fuel, a petroleum fuel, and an alcohol fuel.

13. The powered fastener driving tool of claim 1, wherein the fuel comprises a hydrocarbon gas selected from the group consisting of methane, ethane, propane, butane, ethylene, propylene, butene, butadiene, kerosene, naphtha, gasoline, and combinations thereof.

14. The powered fastener driving tool of claim 1, wherein the fuel comprises propane, butene, or combinations thereof.

15. The powered fastener driving tool of claim 1, which includes a dessicator.

16. A powered fastener driving tool comprising:

a housing configured to support a removable fuel container and an oxidizer container;

a piston chamber in the housing;

a combustion chamber in the housing;

a piston disposed in the piston chamber; and a fastener driving blade connected to the piston and configured to engage and drive a fastener upon a fuel from the fuel container reacting with an oxidizer from the oxidizer container in the combustion chamber, wherein the reaction between the fuel and the oxidizer is a hypergolic reaction.

17. The powered fastener driving tool of claim 16, which includes a catalyst in the combustion chamber.

18. The powered fastener driving tool of claim 16, which includes a dessicator.

* * * * *